US005137059A

United States Patent [19]

Baeck et al.

[11] Patent Number: 5,137,059

[45] Date of Patent: Aug. 11, 1992

[54] EXTRACTION SPEED CONTROL FROM FEED BOBBIN TO WEFT ACCUMULATOR

[75] Inventors: Robert Baeck, De Pinte; Henry Shaw, Woesten-Vleteren; José Vangheluwe, Ieper, all of Belgium

[73] Assignee: Picanol N.V., naamloze vennotschap, Ieper, Belgium

[21] Appl. No.: 684,869

[22] Filed: Apr. 15, 1991

[30] Foreign Application Priority Data

Apr. 27, 1990 [BE] Belgium ..... 9000463

[51] Int. Cl.[5] ..... D03D 47/36

[52] U.S. Cl. ..... 139/452; 242/36; 242/45

[58] Field of Search ..... 139/452; 66/125 R; 242/45, 36

[56] References Cited

U.S. PATENT DOCUMENTS 4,805,846 2/1989 Veda et al. ..... 242/18 R
4,909,286 3/1990 Decock et al. ..... 139/452
4,964,442 10/1990 Tacq et al. ..... 139/452

*Primary Examiner*—Andrew M. Falik
*Attorney, Agent, or Firm*—Bacon & Thomas

[57] ABSTRACT

A method for supplying weft yarn to the shed of a weaving machine of the type in which weft yarn is inserted into the shed from at least two feed bobbins, via respective weft accumulators and insertion devices, includes the step of altering the average yarn extraction speed at which the weft yarn of at least one of the feed bobbins is extracted during unspooling of the bobbin in order to prevent yarn breakage due to an excessively high extraction speed. The method may be carried out by a device which generates a signal representative of the available supply of yarn on a feed bobbin, and controls the yarn extraction speed as a function of the available supply signal. An alternative device for carrying out the method generates a signal representative of a yarn extraction tension and regulates the yarn extraction speed as a fuction of the yarn extraction tension signal.

19 Claims, 2 Drawing Sheets

EXTRACTION SPEED CONTROL FROM FEED BOBBIN TO WEFT ACCUMULATOR

BACKGROUND OF THE INVENTION

The present invention concerns a method and device for supplying weft yarn to the shed of a weaving machine.

As is known, it is possible in a weaving machine to supply the same type of weft yarn to the shed via different yarn feeders. Each yarn feeder hereby consists of at least one feed bobbin, a weft accumulator such as a prewinder, and insertion means to insert the weft yarn into the shed. It is clear that hereby the average amount of weft yarn supplied to the shed per unit of time equals the sum of the average amount of weft yarn taken from the respective feed bobbins being used per unit of time. As the weft yarn is unwound from a feed bobbin, this causes tensions in the weft yarn. It is known that when these tensions exceed a certain limit, the risk of the thread breaking is considerable.

Such tensions are caused among other things by the position of the feed bobbin in relation to the weft accumulator, the nature and geometry of the feed bobbin, the relation of the diameter of the feed bobbin to the distance between the feed bobbin and the next downstream thread guide, and the yarn extraction speed with which said weft yarn is unwound from the feed bobbin.

It is clear that with a given diameter of a given feed bobbin and a given distance between the feed bobbin and the next thread guide, the tension in the weft yarn depends on the yarn extraction speed. As a result, it is possible to determine the yarn extraction speed for each diameter of the feed bobbin at which said tension limit is exceeded, in other words at which the risk of the thread breaking is considerable.

SUMMARY OF THE INVENTION

The present invention concerns a method for supplying weft yarn to the shed which aims to restrict the number of yarn breaks. It particularly concerns a method whereby this is made possible without reducing the weaving speed or the speed at which a particular type of weft yarn is supplied to the shed.

According to a particular embodiment an object of, the present invention is to restrict the number of yarn breaks at the beginning and end of a feed bobbin. Because it is known that most yarn breaks occur at the beginning and end of a feed bobbin, and also during the transfer between two feed bobbins.

To achieve this objective, the invention provides a method for supplying weft yarn to the shed of a weaving machine, whereby a same type of weft yarn can be supplied to the shed from at least two feed bobbins, via respective weft accumulators and insertion means, and wherein the average yarn extraction speed at which the weft yarn is unwound from at least one of the above-mentioned feed bobbins is altered during the unspooling of the feed bobbin by altering the relation between the average amount of the type of weft yarn supplied to the shed per time unit on the one hand, and the average amount of weft yarn unwound from the feed bobbin concerned per time unit on the other hand.

The yarn extraction speed can hereby be altered by supplying a smaller or larger amount of weft yarn from another feed bobbin containing the same type of weft yarn.

Preferably, the yarn extraction speed is altered as a function of the expected risk of yarn breaks.

One possibility is to alter the yarn extraction speed as a function of the yarn extraction tension, whether or not the tension is measured directly.

Another possibility is to alter the yarn extraction speed as a function of the supply of weft yarn still available on the feed bobbin in question, whereby this supply can be measured directly or indirectly. The size of the supply is an indication of the risk of yarn breaks.

Also, according to a preferred embodiment, the method according to the invention allows for the yarn extraction speed at which the weft yarn is unwound from a feed bobbin to be automatically altered at the beginning and end of a feed bobbin, and also during the transfer between two tied-in feed bobbins.

At the end of a feed bobbin, the yarn extraction speed is progressively reduced as a function of the remaining amount of weft yarn, while the speed is progressively increased at the beginning of a new feed bobbin.

The advantage according to the present invention lies in that the yarn extraction tension at a feed bobbin is monitored such that it does not exceed a certain limit, and such that the number of yarn breaks can be restricted without consequently altering the average amount of a particular type of weft yarn supplied to the shed per time unit.

The invention also concerns a device making it possible to realize the preferred method.

BRIEF DESCRIPTION OF THE DRAWINGS

In order to better explain the characteristics of the invention, by way of example only and without being limitative in any way, the following preferred embodiments are described with reference to the accompanying drawings where.

DETAILED DESCRIPTION OF THE PREFERRED EMBODIMENTS

Figure 1:
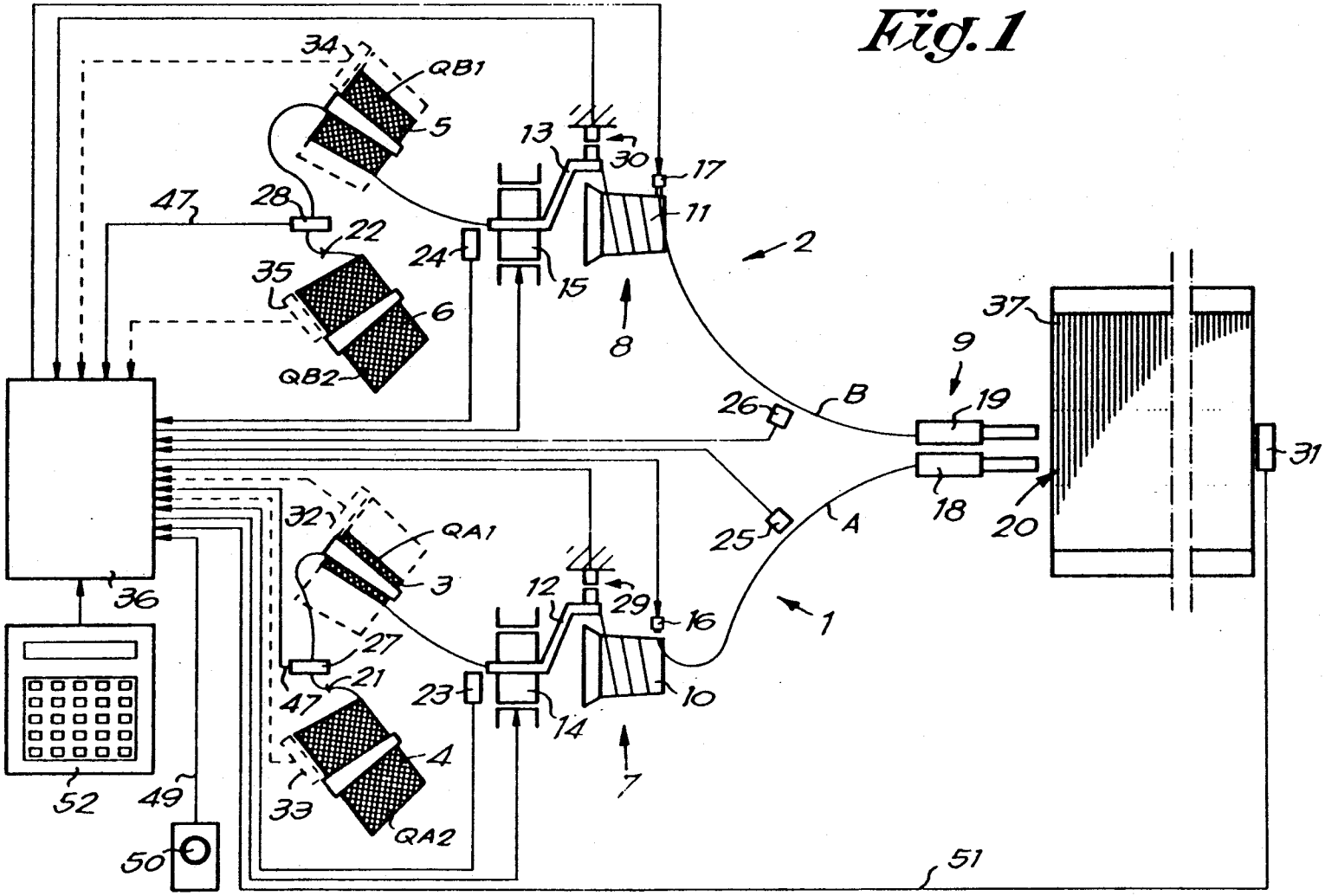
FIG. 1 is a schematic representation of a device according to the invention.

FIG. 1 is a schematic representation of a device for supplying weft yarn to the shed. The device has two yarn feeders 1 and 2, supplying a weft yarn A and a weft yarn B respectively. Each yarn feeder is hereby composed of feed bobbins 3 and 4, and 5 and 6 respectively; a weft accumulator such as a prewinder 7 and 8 respectively; and insertion means 9.

The prewinders 7 and 8 include, as is known, a fixed accumulator drum 10-11, a winding tube 12-13, a drive such as a motor 14-15 to drive the winding tube 12-13, and possibly also a blocking element 16-17 to intermittantly stop the weft yarn A or B, respectively release it from the accumulator drum.

In the embodiments described, the insertion means 9 consist of nozzles 18 and 19 for inserting the weft yarn A or B in the shed 20. It is clear, however, that said insertion means 9 may also consist of one common nozzle, preceded by an exchangeable thread guide. In the case of a gripper weaving machine these insertion means include a thread presentation device with which the weft yarns A and B can be taken to the path of the gripper as required.

As shown in FIG. 1, a reserve feed bobbin connected to the feed bobbin in use can be kept in readiness. To this end, the feed bobbin 4, for example, is connected to the feed bobbin 3, whereas the feed bobbin 6 is connected to the feed bobbin 5, and this by means of knots 21 and 22 or other attachments such as a splice.

Various other elements are also indicated in FIG. 1, such as detectors 23 to 26 for the detection of yarn breaks, detectors 27 and 28 for the detection of a transfer between two feed bobbins, detectors 29 and 30 for the detection of the rotation of the winding tubes 12 and 13, detection means 31 for the detection of the arrival of any weft thread inserted in the shed 20, and possibly also some detectors 32 to 35 to measure the diameters of the feed bobbins 3 to 6.

All the above-mentioned detectors and detection means are connected to the control unit 36 of the weaving machine. This control unit 36 also controls the drives 14 and 15 of the winding tubes 12 and 13 as well as the blocking elements 16 and 17. According to a variant, certain parts of the control unit 36 may be integrated in certain machine components. Thus, the control of the drives 14 and 15 of the winding tubes 12 and 13, and also of the blocking elements 16 and 17 can be executed by control elements which have been built-in in the prewinders.

Also schematically represented in FIG. 1 is the reed 37 of the weaving machine.

As is known, a weft yarn A and/or B is being continuously or almost continuously drawn from a corresponding feed bobbin 3 or 5 and wound on a corresponding accumulator drum 10 or 11 by means of a winding tube 12 and/or 13 during the weaving cycle. On the unspooling side of the accumulator drums, quantities of thread corresponding to the length of the shed 20 are intermittently being taken up.

The drives 14 and 15 of the winding tubes 12 and 13 are hereby controlled by the control unit 36 such that the speed at which the weft yarn is wound on the accumulator drum 10 or 11 is maintained as constant as possible. As a result, the speed at which the weft yarn is drawn from the corresponding feed bobbin 3 or 5 will also be as constant as possible. Due to this control, said speed is almost always equal to the average yarn extraction speed.

It is possible to either use one yarn feeder or several yarn feeders during the weaving. It is clear that when, for example, two yarn feeders are used, the yarn extraction speed at which the weft yarns A and B are unwound from the corresponding feed bobbins 3 and 5 is slower than when only one yarn feeder 1 or 2 is used. As the yarn extraction speed increases, the risk of yarn breaks also increases.

The present invention is special in that the average yarn extraction speed at which the weft yarn A or B of the corresponding feed bobbin 3 or 5 respectively is being unwound, is altered during the unwinding of said feed bobbin, such that the number of yarn breaks, or at least the risk of such yarn breaks, is significantly reduced.

According to the invention, the average yarn extraction speed at which the weft yarn is being unwound from the feed bobbin in question is reduced at those moments when the risk of yarn breaks occuring is usually greater, such as when the same type of weft yarn is supplied from one or several other feed bobbins.

It is known that most yarn breaks occur at the beginning or end of a feed bobbin, and also during a transfer between two interconnected feed bobbins. Thus, the method according to the invention should be primarily applied at these moments. This application is described in detail on the basis of FIG. 1 below.

For example, in the device shown in FIG. 1 it is possible to work with two identical weft yarns A and B, whereby a length of weft thread of the weft yarn A and a length of weft thread of the weft yarn B is alternately supplied to the shed. This can be done for example on the basis of a 1/1 ratio, such that the speeds at which the weft yarns A and B are unwound from the feed bobbins 3 and 5 are equal, thus reducing the risk of yarn breaks.

If it is found that one of the supplies QA1 or QB1 on the feed bobbins 3 or 5 is smaller than a given value, the yarn extraction speed, at which the weft yarn in question of the corresponding feed bobbin is being unwound, is reduced. This value can be set as required and amounts to, for example, 5% of the supply of a full feed bobbin.

FIG. 1 schematically represents the case in which the supply QA1 has reached such a value. From then on, the yarn extraction speed at which the weft yarn A is unwound from the feed bobbin 3 is reduced. This can be done, for example, by first altering the above-mentioned ratio to ½, in other words so that for every three lengths of weft thread consecutively supplied to the shed 20, two lengths come from the prewinder 8 and one length comes from the prewinder 7. Hence, the average yarn extraction speed at which the weft yarn A must be unwound from the feed bobbin 5 is reduced by 33%, as a result of which the load on the remaining supply QA1 is reduced as it is unwound, and consequently the risk of yarn breaks remains small and therefore does almost not increase as is normally the case when the end of a feed bobbin is reached.

The ratio is preferably progressively changed, possibly step by step, as a function of the further unwinding of supply QA1.

A minimum speed is maintained during the transfer from feed bobbin 3 to feed bobbin 4. After the start of the full feed bobbin 4 the yarn extraction speed with which yarn A is extracted from this bobbin 6 is increased again, preferably progressively and possibly step by step, until the yarn extraction speeds of weft yarns A and B at feed bobbins 4 and 5 are equal again. The period during which the yarn speed is increased again can be spread so that it is equal to the first 5% of the supply QA2 on feed bobbin 4.

The following table gives an example of the alteration of said ratio:

| Supply (% of full feed bobbin) | Yarn Supply Ratio (A/B) |
|---|---|
| QA1 = 5% | ½ |
| QA1 = 3% | ½ |
| QA1 = 2% | ½ |
| QA1 = 1% | 1/16 |
| QA1 = 0.5% | 1/32 |
| transfer QA1 to QA2 | 1/32 |
| QA2 = 99.5% | 1/16 |
| QA2 = 99% | ½ |
| QA2 = 98% | ½ |
| QA2 = 97% | ½ |
| QA2 = 95% | 1/1 |

It is clear that the reduction in yarn extraction speed of weft yarn A at feed bobbins 3 and 4 leads to an increase in yarn extraction speed of weft yarn B at feed bobbin 5. As long as the yarn extraction speed of weft yarn B of feed bobbin 5 does not exceed the maximum yarn extraction speed allowed with supply QB1, it will have little or no influence on the risk of a yarn break at feed bobbin 5.

It is clear that said ratios as well as said percentages of the supply in relation to a full feed bobbin can be changed, depending on the kind of weft yarn, the geometry of the feed bobbin etc. These values are determined experimentally for a certain kind of weft yarn, based on the number of yarn breaks which would occur with such a feed bobbin in the case where the yarn extraction speed would not be altered during extraction, or these values are calculated on the basis of mathematical models. If, for example, a ratio of QA1=3% leads to few yarn breaks, the said ratio can then be set to ½ instead of ¼. If it is noticed for example that QA1=8% leads to a lot of yarn breaks, a ½ ratio can, for example, be set as soon as this supply is reached.

These settings can of course be made automatically by the control unit 36, depending on the number of yarn breaks occuring.

Two matters are important when executing the method of this invention, namely the determination of the available supply QA1 and/or QB1 of feed bobbins 3 and 5 in use, and the determination of the moment at which the new feed bobbin is put into operation.

Figure 2:
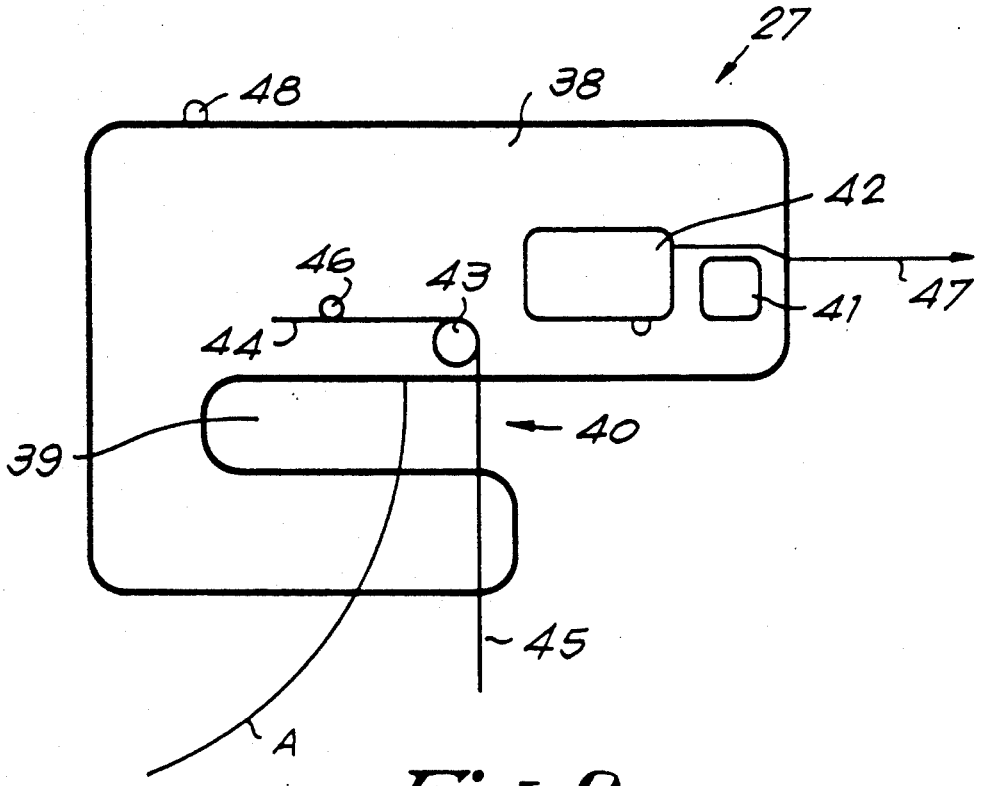
FIGS. 2 and 3 represent two different positions of a detector which observes the transfer between two feed bobbins and which can be implemented in the device according to FIG. 1.
Figure 3:
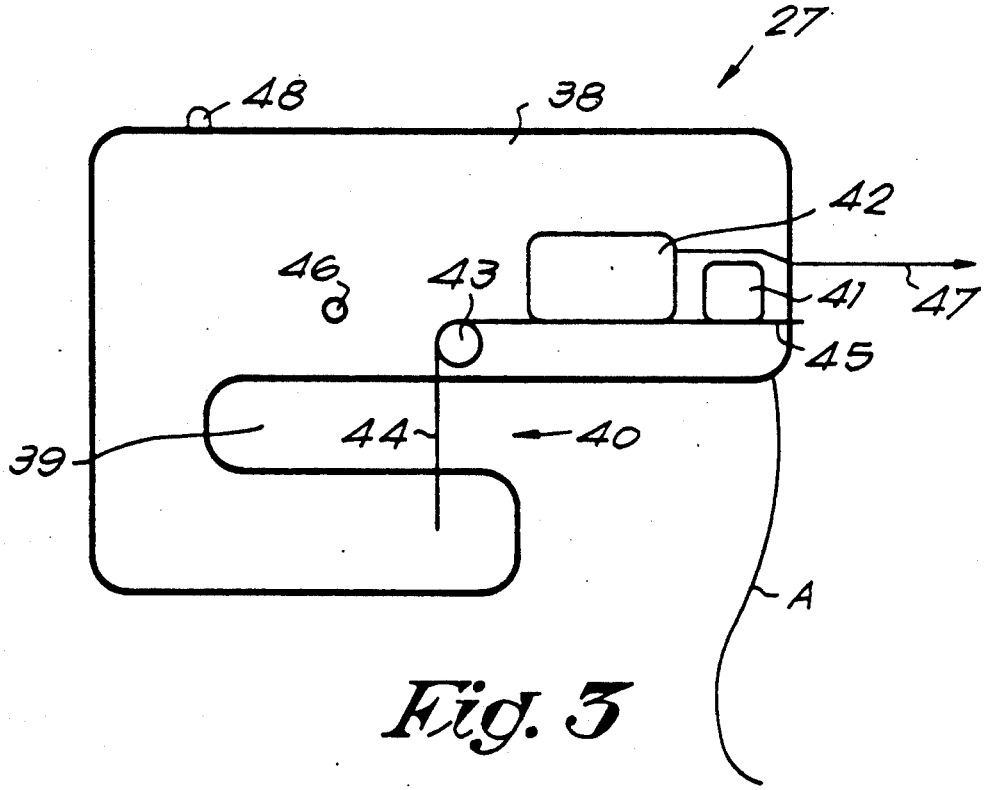

In the case where there is always a spare feed bobbin available, in other words when two feed bobbins 3 and 4, and 5 and 6 respectively, are linked together, the transfer between two feed bobbins can be detected by means of detector 27 or 28 as mentioned before. FIGS. 2 and 3 show an example of such a detector.

The detector in FIGS. 2 and 3 mainly consists of a frame 38 which is provided with a recess 39, a tilting element 40 which operates together with the recess 39, a permanent magnet 41 or similar and a switch element 42. Tilting element 40 is L-shaped, and can be tilted at its angle point via a hinge point 43 and has two legs 44 and 45 of different lengths. The various parts are mounted in such a way that the element 40 can adopt two positions, a position as depicted in FIG. 2 on the one hand, whereby subject to gravity the shortest leg 44 rests on a stop 46, while the longest leg 45 is situated at the recess 39 and thus seals the recess 39 and on the other hand a position as depicted in FIG. 3 whereby the longest leg 45 is kept up by a magnet 41, while the shortest leg 44 is situated at the recess 39 and thus seals the recess 39.

In the situation according to FIG. 1, whereby feed bobbins 3 and 4, respectively 5 and 6 are linked, the respective weft yarn A or B is behind leg 44 in the recess 39. When transferring to the second feed bobbin the respective weft yarn is pulled from the recess 39, which tilts element 40 and puts it into the position in FIG. 3 by means of a permanent magnet 41. This operates a switch element 42, consisting of a micro switch for example, which sends a signal 47 to control unit 36 and whereby a visible signal 48 can possibly be lit or whereby a signal can be sent to a central control unit.

When a new feed bobbin is tied-in, either automatically or manually, the tied together yarn ends are pulled into the recess 39, which results in element 40 returning from its position in FIG. 3 to its position in FIG. 2.

It is clear that other detectors, which may or may not be mounted between feed bobbins 3 and 4, respectively 5 and 6, can also be used to generate the signal 47, as described for example in Belgian patent numbers 905.312 and 1.000.331 of Applicant.

It must be mentioned that, in the embodiment according to FIG. 1, for example, in case a new feed is not tied-in in time, the respective yarn feeder is switched off completely before the existing yarn supply is completely used up.

This means that if in FIG. 1 no feed bobbin 4 is available, the supply of weft yarn A is interrupted before feed bobbin 3 is empty, for example before supply QA1 is less than 1%, and only weft yarn B is used for further weaving.

The advantage of this is that prewinder 7 belonging to the empty feed bobbin 3 remains threaded and consequently does not need to be re-threaded after the introduction of a new feed bobbin 4.

Detectors can be used to establish that no new feed bobbin was tied-in, for example the previously mentioned detectors 32 to 35. Alternatively one can also employ a signal 49 here, which is sent to the control unit 36 by instruction from the weaver, who uses to this end a button 50 every time he has introduced and tied-in a new feed bobbin. If an empty feed bobbin is replaced by an automaton, this signal 49 can be delivered by the automaton doing the replacement.

Determination of the existing supply QA1 and/or QB1 on feed bobbin 3, respectively 4, in use can according to this invention be done in various ways. Following is a description of a few possibilities without being limitative in any way.

Because for the same woven article the same feed bobbins for a certain weft thread in the weaving pattern are usually used, it is relatively simple to check the percentage consumption of weft yarn by means of the number of thread lengths or the number of insertions which have been made from the beginning of the relevant feed bobbin. It is of course necessary here to know how many insertions can be made with a full feed bobbin. The number of insertions can simply be counted in control unit 36 by checking how many times the blocking element 16 or 17 of the relevant weft yarn A or B is opened and/or the insertion means 9 relative to the weft yarn A or B in question are enforced. In the case of a gripper machine, the number of times the thread presentation arm in question is operated, can be counted. The number of insertions can also be counted by means of signal 51 originating from detection means 31, although this is not as accurate, as all insertions are not counted herewith.

The available supply QA1 or QB1 can then be put in terms of percentage as follows:

$$100\,(WT-WI)/WT$$

whereby WT represents the number of insertions that can normally be made with a full feed bobbin, while WI represents the number of insertions executed and counted by control unit 36 from the start of the relevant feed bobbin.

Another possibility to determine the available supply QA1 and/or QB2 is to count the number of accumulations wound on the relevant accumulation drum 10 or 11, for example by means of the previously mentioned detectors 29 and 30.

A further possibility to determine supply QA1 and/or QB1 is the use of detectors 32 to 35 which directly operate with the relevant feed bobbin and for example measure its diameter. These detectors 32 to 35 then release a signal when the diameter reaches a certain value, for example when this diameter amounts to 5% of the diameter of a full feed bobbin.

It is clear that certain details, such as the type of feed bobbins or the length of thread available on a full feed bobbin, can be entered by the weaver by means of a reading device 52. It is clear that the device can also auto-instruct, so that the amount of thread on the new feed bobbins is measured beforehand by detectors 32 to 35, from which the control unit 36 measures the total length of thread available on the feed bobbin or so that the amount of thread on a feed bobbin can be determined by the amount of thread removed between two signals from detectors 27 and 28.

It is clear that it is not necessary to weave with two yarn feeders 1 and 2 or several yarn feeders. The invention can also be used when, during the normal weaving process, the weft yarn is fed from only one yarn feeder. For example in FIG. 1 weft yarn A is exclusively fed during the normal weaving process, while yarn feeder 2 is kept ready in reserve. Thus for example at a certain moment when supply QA1 becomes less than a certain value, for example 10% of the supply of a full feed bobbin, the second yarn feeder 2 can be put into operation, whereby then for example equal amounts of weft yarn A and B are alternately fed to shed 20 and whereby after a certain time, for example as soon as supply QA1 amounts to 5% of the supply of a full feed bobbin, the previously described method is applied.

Thus the device according to the invention, for example, can be combined with the device known from EP 346.967. According to this patent application a yarn feeder is kept in reserve. Several chosen weft yarns chosen can be fed in by means of the reserve yarn feeder, so that in case of a yarn break in one of the normally used yarn feeders, to the reserve yarn feeder is started, and then automatically supplies the same weft yarn as the weft yarn in which the yarn break happened. It is clear that the reserve yarn feeder is only used sporadically and that the yarn feeder according to the present invention can also be used to apply the method of the present invention, in other words, to temporarily supply an additional yarn feed, i.e. at the start and at the end of the normally used feed bobbin.

Evidently three or more yarn feeders can be used, whereby in the case of an almost full or empty feed bobbin, the yarn extraction speed with which the weft yarn is extracted from the feed bobbin, is decreased by feeding in more weft yarn from one or more other feed bobbins.

In a different version of this invention, the changes in yarn extraction speed at the feed bobbin are not only made as a function of the size of the supply available in the feed bobbin, but also as a function of the size of the supply available on the other feed bobbin, in particular the feed bobbin supplying the same type of weft yarn. That means that for example in FIG. 1 the yarn extraction speed of weft yarn A is also changed as a function of supply QB1. This avoids both feed bobbins 3 and 5 running out together. It is clear that all supplies are checked for this, as well as compared with one another, to determine beforehand whether a critical situation will present itself, in order to intervene as previously mentioned. The following is an explanatory example thereof.

If for example, a weft length of yarn B is inserted into shed 20 for every weft length of weft yarn, then, when the supplies QA1 and QB1 are equal at a certain moment, the two feed bobbins 3 and 5 will run out together. In order to avoid this, when it is noticed that supplies QA1 and QB1 are virtually equal, the previously mentioned regularity is interrupted for a while, so that the feed bobbins do not run out together. Thus, for example, when the supplies on both feed bobbins 3 and 5 are simultaneously at 50%, only weft yarn A is fed to shed 20 until the supply QA1 is 10%, after which weaving can be continued at a 1/1 ratio. This will avoid the situation where both the supply on feed bobbin 3 and the supply on feed bobbin 5 reached a 5% value at the same time.

It is clear that the latter method can also be applied if the same type of weft yarn is inserted into shed 20 via two yarn feeders.

In a variation of the invention the yarn extraction speed is regulated as a function of the tension in weft yarn A or B between feed bobbin 3, 5 respectively, and the weft accumulator 7, 8 respectively. As this tension is a measure of the chance of yarn breaks, the yarn extraction speed can be adjusted so that the tension always remains under a certain value, the value depending on different parameters, for example the type of weft yarn.

To regulate the yarn extraction speed as a function of the tension in the extracted weft yarn, detectors 23 and 24 can be set up as tension detectors giving a signal as a function of the size of the tension measured to control unit 36.

If it is noticed that the tensions measured by detectors 23 and 24 are developing in such a way that this will lead to a critical condition at both feed bobbins 3 and 5, the usual regularity for the feeding of weft yarns A and B is interrupted for a while, so that the above mentioned critical conditions will not manifest themselves simultaneously anymore. It is clear that the tensions in weft yarns A and B, and possibly other weft yarns, are therefore permanently compared and it is established from this whether a critical situation will present itself within a certain period of time.

In case both feed bobbins 3 and 5 do run out together after all, or when the two full feed bobbins 4 and 6 are taken into operation simultaneously, or when a feed bobbin runs out simultaneously with a full feed bobbin being taken into operation, a special method is applied. However, the chances of the latter happening are very slim.

In case both feed bobbins 3 and 5 run out almost at the same time, whereby supplies QA1 as well as QB1 have dropped below a certain threshold, for example 5% of the total supply, a ratio between the number of insertions of weft yarn A and weft yarn B is maintained so that the yarn extraction tensions for both weft yarns A and B are kept to a minimum.

Also in case two feed bobbins, for example feed bobbins 4 and 6, are started simultaneously, a ratio between the number of insertions of weft yarn A and weft yarn B is maintained for a certain period of time, so that the yarn extraction tensions for both weft yarns A and B are kept to a minimum.

Also in case only one feed bobbin is started, while the other is almost completely used up, a ratio between the number of insertions of the weft yarn of the feed bobbin which is running out and the weft yarn of the almost full feed bobbin is maintained for a certain period of time, so that the yarn extraction tensions for both weft yarns A and B are kept to a minimum.

It is clear that the yarn extraction tensions for both weft yarns A and B will be kept to a minimum by altering the yarn extraction speeds with which the weft yarns A and B are removed from both feed bobbins depending on the available supply of weft yarn on both feed bobbins or depending on the yarn extraction tensions in the weft yarns of both feed bobbins. For example for every three insertions of weft yarn A, two insertions of weft yarn B are fed into shed 20. It is clear here that insertions from the repsective feed bobbins will be alternately fed to the shed 20 as much as possible.

If one of the detectors 23 to 26 notices a yarn break, the relevant yarn feeder is disconnected. In this case the device according to the invention can be applied in combination with other devices in order to avoid interrupting the weaving process. The device known from EP 195.469 can be used to this extent. According to this patent in the case of a yarn break happening in one of the yarn feeders, another yarn feeder will supply the same weft yarn. To ensure continuity of the weaving process when a yarn break occurs the invention can also be combined with a device as described in EP 346.967, whereby a reserve yarn feeder supplies the same weft yarn.

The invention also relates to a device covering the above mentioned method. This device, as described in FIG. 1, includes at least two yarn feeders 1-2, each made up of at least one feed bobbin 3-5, a weft accumulator 7-8 and possibly joint insertion means 9. Joint insertion means 9, give off a signal representing the amount of weft yarn still available on at least one feed bobbin. Also included is a control unit 36 which at least regulates the speed with which the weft yarn is pulled from the feed bobbins, as a function of above mentioned signal.

As mentioned the above, it is clear that such means for the release of a signal as a function of the amount of yarn still available on the feed bobbins, include detectors 29 and 30, the operators of blocking elements 16 and 17, or detectors 32 to 35, in combination with a suitable calculation unit preferably integrated in control unit 36. These means also apply to button 50 with which such a signal can also be delivered.

The present invention is in no way limited to the applications described in the examples and depicted in the various figures, but such method and device for the supply of weft yarn to the shed of a weaving machine can be employed in various ways without leaving the scope of this invention.

We claim:

1. A method for supplying weft yarn to a shed of a weaving machine, said weaving machine comprising means for supplying a same type of weft yarn to the shed from at least two feed bobbins, via respective weft accumulators and insertion means for inserting weft yarns into the shed, comprising the step of altering an average yarn extraction speed at which weft yarn is extracted from at least one of said feed bobbins during unspooling thereof, said step of altering an average yarn extraction speed comprising the step of changing a ratio between an average amount of said weft yarn supplied to the shed per unit time and an average amount of said weft yarn extracted from said one of said feed bobbins per unit time.

2. A method as claimed in claim 1, wherein said step of altering said yarn extraction speed comprises the step of supplying to the shed a second weft yarn from another of said at least two feed bobbins, said second weft yarn being of a same type as said first weft yarn.

3. A method as claimed in claim 1, wherein said step of altering said yarn extraction speed comprises the step of altering said speed as a function of the probability that yarn breaks will occur.

4. A method as claimed in claim 1, wherein said step of altering the yarn extraction speed comprises the step of altering the yarn extraction speed as a function of an average yarn extraction tension present in the weft yarn between the unspooling feed bobbin and the weft accumulator.

5. A method as claimed in claim 4, wherein said step of altering the yarn extraction speed comprises the step of altering the yarn extraction speed as a function of an average yarn extraction tension at which a same type of weft yarn is extracted from a second of said feed bobbins.

6. A method as claimed in claim 1, wherein said step of altering the yarn extraction speed comprises the step of altering the yarn extraction speed as a function of the amount of weft yarn available on the unspooling feed bobbin.

7. A method as claimed in claim 6, wherein the step of altering the yarn extraction speed comprises the step of decreasing the yarn extraction speed when extraction of weft yarn from a second of said at least two feed bobbins is begun.

8. A method as claimed in claim 6, wherein the step of altering the yarn extraction speed comprises the step of altering the yarn extraction speed as a function of the amount of weft yarn available on a second of said feed bobbins.

9. A method as claimed in claim 7, wherein the step of altering the yarn extraction speed further comprises, at the start of the second feed bobbin, the step of progressively increasing the yarn extraction speed until the supply on the second feed bobbin has reached a predetermined value.

10. A method as claimed in claim 7, wherein said step of altering the yarn extraction speed further comprises the step of measuring supplies of weft yarn on said feed bobbins and altering the yarn extraction speed as a function of a signal representing the supplies on the feed bobbins.

11. A method as claimed in claim 10, wherein said step of measuring the supplies on the feed bobbins comprises the step of determining the supplies according to the number of insertions made from the time at which supply of weft yarn from one of said feed bobbins begins.

12. A method as claimed in claim 10, wherein the step of measuring the supplies on the feed bobbins comprises the step of measuring the supplies according to the number of weft yarn windings made to a respective accumulator drum from the time at which supply of weft yarn from one of said feed bobbins begins.

13. A method as claimed in claim 10, wherein the step of measuring the supplies on the feed bobbins comprises the step of directly measuring the amount of yarn on the feed bobbins by means of detectors.

14. A method as claimed in claim 7, wherein said weaving machine comprises connected feed bobbins, and further comprising the step of detecting by a detector the start of a second of said feed bobbins, said detector operating on the weft yarn between the connected feed bobbins.

15. A method as claimed in claim 6, wherein the step of altering the yarn extraction speed comprises the step of decreasing the yarn extraction speed as the amount of yarn on the unspooling feed bobbin approaches zero.

16. A method as claimed in claim 15, wherein the step of decreasing the yarn extraction speed comprises the step of progressively decreasing the yarn extraction speed when the supply on the unspooling feed bobbin falls below a predetermined value.

17. A method as claimed in claim 1, wherein said weaving machine comprises connected feed bobbins and wherein the step of altering the yarn extraction speed comprises the step of decreasing the yarn extraction speed during transfer between the connected feed bobbins.

18. A device for supplying weft yarn to a shed of a weaving machine, comprising means including at least two yarn feeders for supplying a same type of weft yarn to the shed, each of said at least two yarn feeders including at least one feed bobbin, a weft accumulator, and insertion means for inserting weft yarns into the shed; means for generating a signal representative of the available supply on at least one of said feed bobbins; and a control unit comprising means for altering an average yarn extraction speed at which weft yarn is extracted from at least one of said feed bobbins during unspooling thereof, said means for altering the average yarn extraction speed comprising means for changing the ratio between an average amount of said weft yarn supplied to the shed per unit time and an average amount of said weft yarn extracted from said one of said feed bobbins per unit time, said control unit further comprising means for regulating a yarn extraction speed by which at least one weft yarn is extracted from a feed bobbin, as a function of said signal representative of the available supply.

19. A device for supplying weft yarn to a shed of a weaving machine, comprising means including at least two yarn feeders for supplying a same type of weft yarn to the shed, each of said at least two yarn feeders including at least one feed bobbin, a weft accumulator, and insertion means for inserting weft yarns into the shed; at least one tension detector including means for generating a signal representative of a yarn extraction tension between one of said feed bobbins and a corresponding weft accumulator; and a control unit comprising means for altering an average yarn extraction speed at which weft yarn is extracted from at least one of said feed bobbins during unspooling thereof, said means for altering the average yarn extraction speed comprising means for changing the ratio between an average amount of said weft yarn supplied to the shed per unit time and an average amount of said weft yarn extracted from said one of said feed bobbins per unit time, said control unit further comprising means for regulating a yarn extraction speed of at least said weft yarn whose extraction tension is being measured, as a function of said yarn extraction tension.

* * * * *